US010166598B2

(12) United States Patent
Oguma et al.

(10) Patent No.: US 10,166,598 B2
(45) Date of Patent: Jan. 1, 2019

(54) PRECISION-CASTING CORE, PRECISION-CASTING CORE MANUFACTURING METHOD, AND PRECISION-CASTING MOLD

(71) Applicant: MITSUBISHI HEAVY INDUSTRIES, LTD., Tokyo (JP)

(72) Inventors: Hidetaka Oguma, Tokyo (JP); Kazutaka Mori, Tokyo (JP); Ikuo Okada, Tokyo (JP); Sachio Shimohata, Tokyo (JP)

(73) Assignee: MITSUBISH HEAVY INDUSTRIES, LTD., Tokyo (JP)

( * ) Notice: Subject to any disclaimer, the term of this patent is extended or adjusted under 35 U.S.C. 154(b) by 263 days.

(21) Appl. No.: 14/893,101

(22) PCT Filed: May 28, 2014

(86) PCT No.: PCT/JP2014/064151

§ 371 (c)(1),
(2) Date: Nov. 23, 2015

(87) PCT Pub. No.: WO2014/192819

PCT Pub. Date: Dec. 4, 2014

(65) Prior Publication Data

US 2016/0101462 A1 Apr. 14, 2016

(30) Foreign Application Priority Data

May 29, 2013 (JP) ..... 2013-113127
May 29, 2013 (JP) ..... 2013-113128
May 29, 2013 (JP) ..... 2013-113132

(51) Int. Cl.
*B22C 9/10* (2006.01)
*B22C 3/00* (2006.01)
(Continued)

(52) U.S. Cl.
CPC ..... *B22C 9/10* (2013.01); *B22C 3/00* (2013.01); *B22C 9/02* (2013.01); *B22C 9/04* (2013.01); *B22C 9/12* (2013.01); *B22C 9/24* (2013.01)

(58) Field of Classification Search
CPC .... B22C 3/00; B22C 9/02; B22C 9/04; B22C 9/10; B22C 9/12; B22C 9/24
(Continued)

(56) References Cited

U.S. PATENT DOCUMENTS 2,948,935 A 8/1960 Carter
4,108,672 A 8/1978 Klug et al.
(Continued)

FOREIGN PATENT DOCUMENTS

CN 101890474 11/2010
CN 102179477 9/2011
(Continued)

OTHER PUBLICATIONS

International Search Report dated Aug. 19, 2014 in International Application No. PCT/JP2014/064151.
(Continued)

*Primary Examiner* — Kevin P Kerns
(74) *Attorney, Agent, or Firm* — Wenderoth, Lind & Ponack, L.L.P.

(57) ABSTRACT

A coating layer including solely silicon alkoxide or mixed alkoxide of silicon alkoxide and aluminum alkoxide is formed on a surface of a sintered precision-casting core body mainly including silica particles so as to seal holes formed in the surface. As a result, it is possible to prevent the breakage of the core during casting.

3 Claims, 9 Drawing Sheets

(51) Int. Cl.

| | |
|---|---|
| ***B22C 9/02*** | (2006.01) |
| ***B22C 9/04*** | (2006.01) |
| ***B22C 9/12*** | (2006.01) |
| ***B22C 9/24*** | (2006.01) |

(58) Field of Classification Search
USPC ..... 164/23, 516, 519, 361, 369
See application file for complete search history.

(56) References Cited

U.S. PATENT DOCUMENTS

| | | | | |
|---|---|---|---|---|
| 4,184,885 | A | 1/1980 | Pasco et al. | |
| 4,923,665 | A * | 5/1990 | Andersen et al. | B28B 7/342 106/38.2 |
| 6,540,013 | B1 | 4/2003 | Doles | |
| 2013/0264460 | A1 | 10/2013 | Yamao et al. | |

FOREIGN PATENT DOCUMENTS

| | | |
|---|---|---|
| JP | 59-42155 | 3/1984 |
| JP | 63-140740 | 6/1988 |
| JP | 6-99246 | 4/1994 |
| JP | 6-182490 | 7/1994 |
| JP | 6-190502 | 7/1994 |
| JP | 6-340467 | 12/1994 |
| JP | 7-47444 | 2/1995 |
| JP | 11-320028 | 11/1999 |
| JP | 2001-286978 | 10/2001 |
| JP | 2003-56354 | 2/2003 |
| JP | 2003-170245 | 6/2003 |
| JP | 2004-528988 | 9/2004 |
| WO | 2012/090541 | 7/2012 |

OTHER PUBLICATIONS

Written Opinion of the International Searching Authority dated Aug. 19, 2014 in International Application No. PCT/JP2014/064151.

Office Action dated Feb. 15, 2017 in corresponding German Application No. 112014002613.1 (with English translation).

U. C. Nwaogu et al., "Foundry Coating Technology: A Review", Materials Sciences and Application, vol. 2, (2011) pp. 1143-1160.

Notification of First Office Action dated Aug. 3, 2016 in corresponding Chinese patent application No. 201480029610.2 with English translation.

* cited by examiner

PRECISION-CASTING CORE, PRECISION-CASTING CORE MANUFACTURING METHOD, AND PRECISION-CASTING MOLD

FIELD

The present invention relates to a precision-casting core, a precision-casting core manufacturing method, and a precision-casting mold.

BACKGROUND

As a precision-cast product, for example, a turbine blade used in a gas turbine is known. In the gas turbine, a working fluid is heated by a burner so as to be a high-temperature/high-pressure working fluid, and the turbine is rotated by the working fluid. That is, the working fluid compressed by a compressor is heated by the burner so as to increase the energy of the working fluid, the energy is recovered by the turbine so as to generate a rotation force, and hence electric power is generated by the rotation force. The turbine is provided with a turbine rotor, and the outer periphery of the turbine rotor is provided with at least one gas turbine blade.

Here, the gas turbine blade is exposed to a high temperature. As a countermeasure, a cooling medium flows in the gas turbine blade so as to cool the gas turbine blade. For this purpose, the gas turbine blade is provided with an internal cooling structure. Then, in order to form the internal cooling structure, a core having the same shape as a cooling medium flow passage is disposed and the core is removed after casting. The core is removed while being dissolved in an alkali (for example, NaOH or KOH) solution. As a result, for example, the internal cooling structure for the turbine blade is formed.

As the core, a ceramic core using ceramic particles has been used from the past (Patent Literature 1).

Here, a precision-casting core can be obtained by molding a silica material such as melted silica ($SiO_2$) through injection molding or slip casting and performing a heat treatment thereon.

The injection molding method is a method of obtaining a compact by kneading ceramic powder and wax, injecting a material obtained by heating and melting the wax into a metal mold, and cooling and hardening the material.

Further, the slip casting method is a method of preparing slurry by mixing ceramic powder with water or the like, pouring the slurry into a mold formed of a material such as gypsum absorbing a solution, and drying the slurry so as to obtain a desired molded shape.

CITATION LIST

Patent Literature

Patent Literature 1: Japanese Laid-open Patent Publication No. 6-340467

SUMMARY

Technical Problem

Incidentally, since the existing core is mainly manufactured in consideration of alkali solubility, a problem arises in that the high-temperature strength of the core is low. Further, in the injection molding method, a plurality of holes is formed in the surface of the core which is sintered after molding. As a result, a problem arises in that the strength is low and the core may be broken from the holes as the start points during casting.

Accordingly, there has been a demand for the precision-casting core the high-temperature strength of which is improved.

The invention is made in view of the above-described circumstance, and an object thereof is to provide a precision-casting core with improved high-temperature strength, a precision-casting core manufacturing method, and a precision-casting mold.

Solution to Problem

According to a first aspect of the present invention to solve the above mentioned problems, there is provided a precision-casting core obtained by forming a coating layer of two kinds of silica materials having different particle diameters on a surface of a sintered precision-casting core body mainly including silica particles.

According to a second aspect, in the first aspect, there is provided the precision-casting core, wherein two kinds of silica materials having different particle diameters include silica sol and silica fume.

According to a third aspect, there is provided a precision-casting core obtained by forming a coating layer including a silica material and an alumina material on a surface of a sintered precision-casting core body mainly including silica particles.

According to a fourth aspect, there is provided a precision-casting core obtained by forming a coating layer including a silica material, an alumina material, and silica fume on a surface or a sintered precision-casting core body mainly including silica particles.

According to a fifth aspect, in the third or fourth aspects, there is provided the precision-casting core, wherein the silica material is silica sol and the alumina material is alumina sol.

According to a sixth aspect, there is provided a precision-casting mold, used to manufacture cast metal, comprising the precision-casting core of the first, second or third aspects having a shape corresponding to a cavity inside the cast metal and an outer mold corresponding to the shape of the outer peripheral surface of the cast metal.

According to a seventh aspect, there is provided a precision-casting core manufacturing method comprising immersing a sintered body of a precision-casting core body mainly including silica particles into a coating material including two kinds of silica materials having different particle diameters, drying the sintered body and heating the sintered body so as to form a coating layer on the surface of the precision-casting core body.

According to an eighth aspect, in the seventh aspect, there is provided the precision-casting core manufacturing method, wherein two kinds of silica materials having different particle diameters include silica sol and silica fume.

According to an ninth aspect, there is provided a precision-casting core manufacturing method comprising immersing a sintered body of a precision-casting core body mainly including silica particles into a coating material including a silica material and an alumina material, drying the sintered body and heating the sintered body so as to form a coating layer on the surface of the precision-casting core body.

According to an tenth aspect, there is provided a precision-casting core manufacturing method comprising immersing a sintered, body of a precision-casting core body mainly including silica particles into a coating material including a silica material, an alumina material and silica fume, drying the sintered body and heating the sintered body so as co form a coating layer on the surface of the precision-casting core body.

According to an eleventh aspect, in the ninth or tenth aspects, there is provided the precision-casting core manufacturing method, wherein the silica material is silica sol and the alumina material is alumina sol.

Advantageous Effects of Invention

Since the invention has a configuration in which the coating layer of two kinds of silica materials having different particle diameters is formed on the surface of the sintered, precision-casting core body, the holes formed in the surface thereof during sintering are sealed. Accordingly, there is an effect that the breakage of the core is prevented during casting in that the strength of the core is improved and the holes are sealed.

DESCRIPTION OF EMBODIMENTS

Hereinafter, the invention will be described in detail with reference to the drawings. Furthermore, the invention is not limited to the description below. Further, the components to be described below include a component which can be easily supposed by the person skilled in the art, a component which has substantially the same configuration, and a so-called equivalent component.

Figure 1:
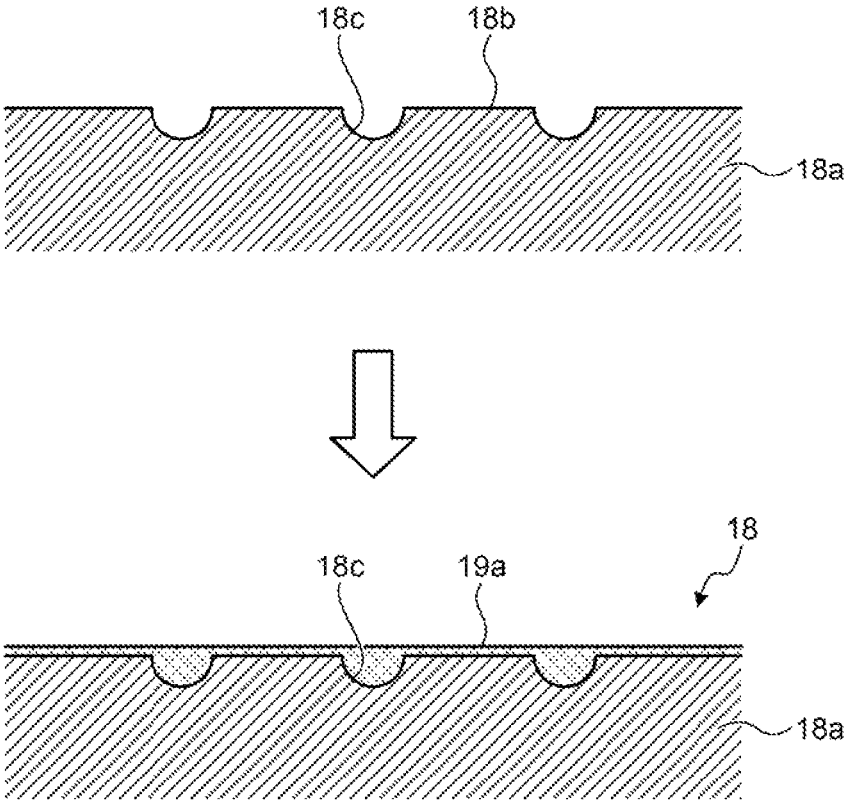
FIG. 1 is a cross-sectional configuration diagram of a precision-casting core.

FIG. 1 is a cross-sectional configuration diagram of a precision-casting core.

A precision-casting core according to the invention is obtained by forming a coating layer of two kinds of silica materials having different particle diameters on a surface of a sintered precision-casting core body (hereinafter, referred to as a "core body") mainly including silica particles.

First Embodiment

As illustrated in the upper stage of the cross-sectional view of the core body as the sintered body of FIG. 1, a plurality of holes 18*c* is formed in a surface 18*b* of a core body 18*a* during sintering.

In the invention, as illustrated in the lower stage of FIG. 1, the holes 18*c* formed in the surface is coated by a coating layer 19*a* so as to seal the holes 18*c*.

Here, the core body 18*a* mainly includes silica particles, for example, melted silica ($SiO_2$) such as silica sand and silica flour.

The core body is manufactured by a known method in which wax is added to a mixture prepared by mixing silica particles, for example, silica flour (for example, 800 mesh (10 to 20 μm) and silica sand (for example, 220 mesh (20 to 70 μm)) at the weight ratio of 1:1 and is heated and kneaded so as to obtain a compound.

A core compact is obtained by injection molding the obtained compound.

Subsequently, the core body 18*a* is obtained by performing a decreasing treatment to, for example, 600° C. and a sintering treatment at, for example, 1,200° C.

In the invention, the coating layer 19*a* is formed on the surface of the core body 18*a* as the obtained sintered body.

In the coating layer 19*a*, two kinds of silica materials having different particle diameters are used.

Here, in two kinds of silica materials having different particle diameters, silica sol ($SiO_2$ of 30 wt %) is used as a first, material and silica fume (a particle diameter of 0.15 μm) is used as a second material.

In the invention, silica sol-silica fume slurry is prepared by adding and dispersing silica fume to silica sol.

Here, silica sol and silica fume are kneaded at one weight ratio of 1:1 to 4:1. In the ratio of silica micro particles in silica sol in the silica sol-silica fume slurry kneaded at the weight ratio of 2:1, a sol solid content and silica fume were set as the ratio of 30:50.

The sintered core body is immersed into the obtained silica sol-silica fume slurry, and is pulled up later so as to form the coating layer 19*a* formed of silica sol-silica fume on the surface of the core body 18*a*. When the coating layer 19*a* is formed, the slurry component also intrudes into the holes 18*c* of the surface of the core, and hence a silica sol-silica fume component is also precipitated in the holes of the core after the core body is dried.

Subsequently after the drying process, a heat treatment is performed at, for example, 1,000° C. The heat treatment may be performed at, for example, 1,000° C. or less if the coating layer 19*a* is formed on the surface.

In the obtained coating layer 19*a*, since a gap of silica fume having a large particle diameter is filled fey silica sol having a small particle diameter in the silica material as a constituent material, a compact layer is formed by the finely filling state.

Further, since silica fume has a spherical shape, silica sol having a small particle diameter easily intrudes into a gap of silica fume particles having a large particle diameter, and hence the silica material is further finely filled. Furthermore, since silica sol of micro particles improves the adhesion strength among the particles, they contributes to the improvement in strength.

In this way, according to the invention, the high-temperature strength of the precise-casing core is improved.

Test Example 1

Hereinafter, a test example for verifying the effect of the invention will be described.

In the test example, a compound was first obtained by adding wax to a mixture prepared by mixing silica flour (300 mesh) and silica sand (220 mesh) at the weight ratio of 1:1 and heating and kneading the mixture. Here, "MCF-200°

C." (product name) manufactured by Tatsumori Ltd. was used as silica flour, "RD-120" (product name) manufactured by Tatsumori Ltd. was used as silica sand, and "Cerita Wax F30-75" (product name) manufactured by Paramelt Co., Ltd., was used as was.

A compact was obtained by injection molding the obtained compound.

As a test sample 1, a sample having a width of 30 mm, a length of 200 mm, and a thickness of 5 mm was obtained.

Next, a sample for a core body was obtained by performing a decreasing treatment to 600° C. and a sintering treatment at 1,200° C.

Next, silica sol-silica fume slurry was prepared by adding and dispersing silica fume (having a particle diameter of 0.15 μm and a spherical shape) to silica sol ($SiO_2$ of 30 wt %) (silica sol and silica fume were kneaded at the weight ratio of 2:1). At this time, in the ratio of silica micro particles in silica sol, a sol solid content and silica fume were set as the ratio of 30:50.

The sample for the core body was immersed into the obtained silica sol-silica fume slurry and was pulled up so as to form the coating layer 19*a* of silica sol-silica fume on the surface thereof. Subsequently after the drying process, a heat treatment was performed at 1,000° C. so as to form the coating layer 19*a* formed of silica sol-silica fame on the core body surface 18*b*.

As a comparative example, a core body without, a coating layer was prepared as Comparative Sample 1.

The strength of each of the test samples was measured.

Here, the strength test was performed based on "Bending Strength of Ceramics (1981)" of JIS R 1601.

The strength of the comparative sample without the coating layer of the conventional method was 20 MPa, but, to the contrary, the strength of the sample for the core body according to the method of the invention was 25 MPa. As a result, in the sample for the core body of the invention, it was acknowledged that the strength was improved by 25%.

Hereinafter, a casting method using a mold having the precision-casting core of the invention disposed therein will be described.

Figure 2:
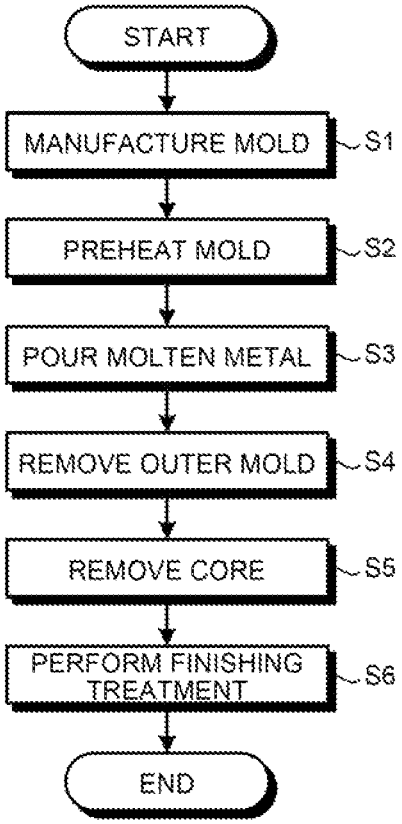
FIG. 2 is a flowchart illustrating an example of a process of a casting method.

FIG. 2 is a flowchart illustrating an example of a process of the casting method. Hereinafter, the casting method will be described with reference to FIG. 2. Here, the process illustrated in FIG. 2 may be totally automatically performed or may be performed by the operator operating each device dedicated for the process. In the casting method of the embodiment, a mold is manufactured (step S1). The mold may be manufactured in advance or may be manufactured for each casting.

Figure 3:
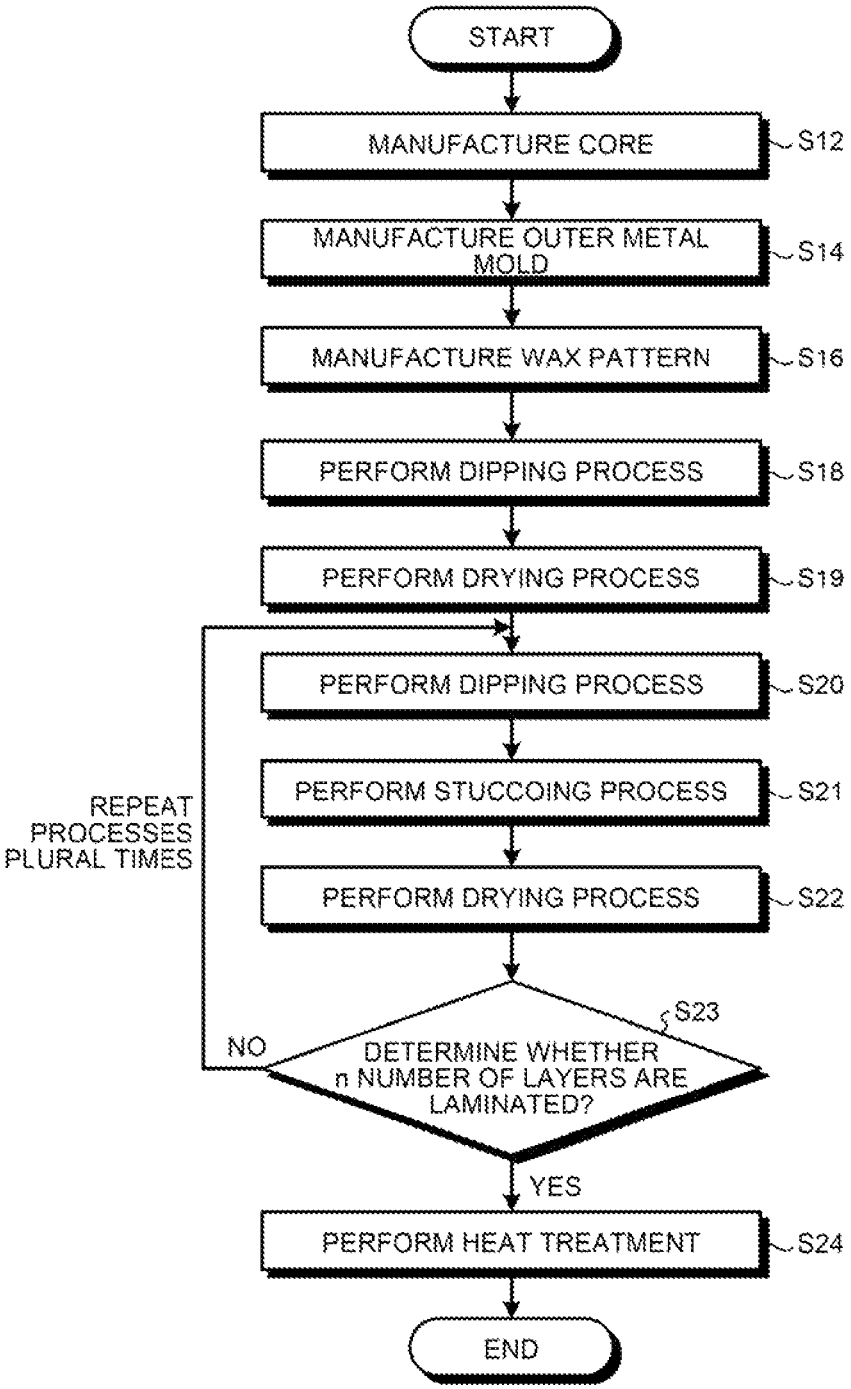
FIG. 3 is a flowchart illustrating an example of a process of a mold manufacturing method.

Hereinafter, the mold manufacturing method of the embodiment performed by the process of step S1 will be described with reference to FIGS. 3 to 9. FIG. 3 is a flowchart illustrating an example of the process of the mold manufacturing method. Here, the process illustrated in FIG. 3 may be totally automatically performed or may be performed by the operator operating each device dedicated for the process.

In the mold manufacturing method, a core is manufactured (step S12). The core has a shape corresponding to the cavity inside the cast metal manufactured by the mold. That is, since the core is disposed at a portion corresponding to the cavity inside the cast metal, it is possible to suppress metal as the cast metal from flowing thereinto during casting. Hereinafter, the core manufacturing process will be described with reference to FIG. 4.

Figure 4:
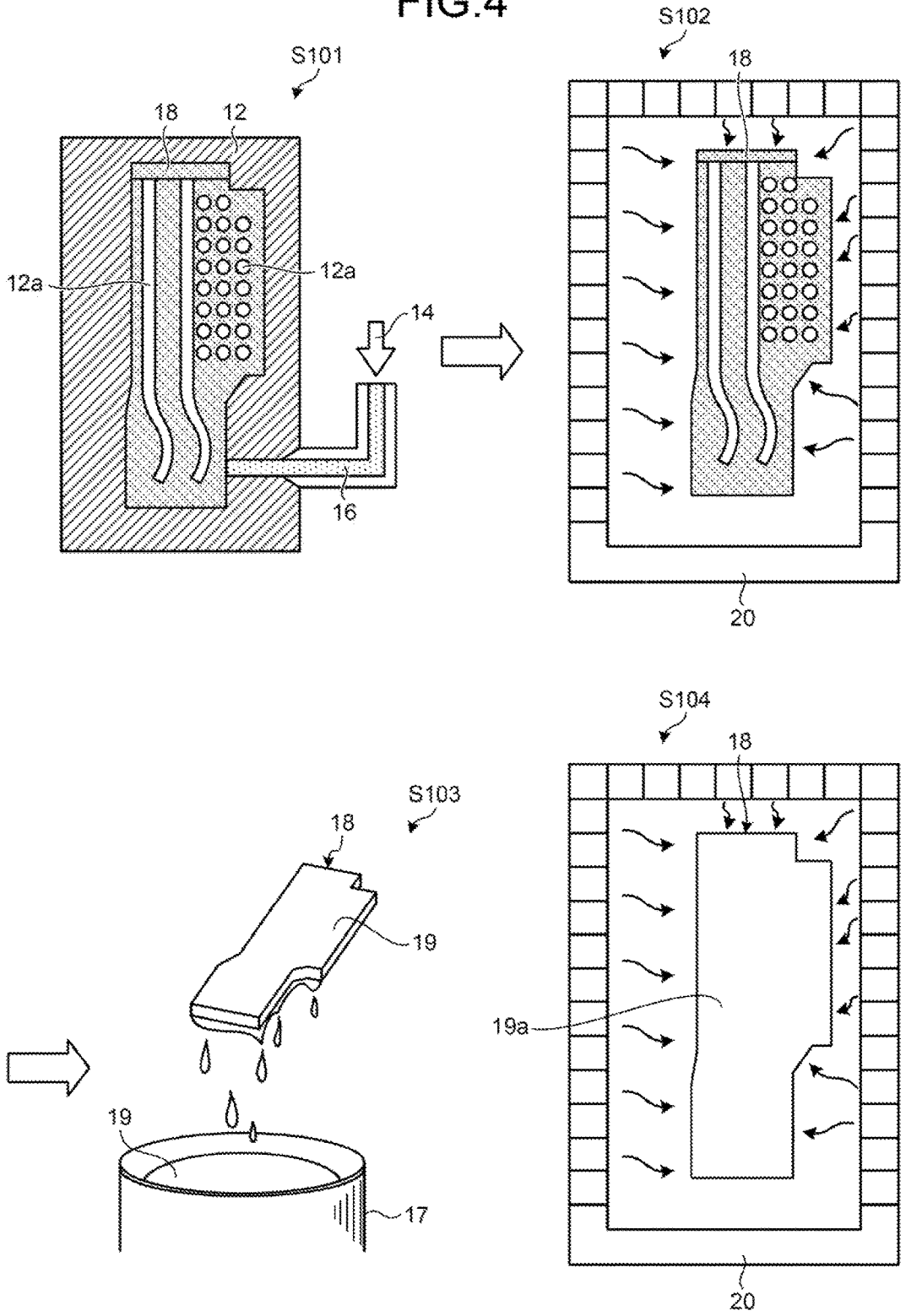
FIG. 4 is a schematic diagram illustrating a core manufacturing process.

FIG. 4 is a schematic diagram illustrating the core manufacturing process. In the mold manufacturing method, a metal mold 12 is prepared as illustrated in FIG. 4 (step S101). The metal mold 22 is formed so that an area corresponding to the core is formed as a cavity. A portion formed as a cavity of the core is formed as a convex portion 12*a*. Furthermore, although it is illustrated in the cross-section of the metal mold 12 in FIG. 4, the metal mold 12 is formed so that an area other than an opening for injecting a material into a space therethrough or a hole for releasing air therethrough is basically formed as a cavity covering the entire periphery of an area corresponding to the core. In the mold casting method, ceramic slurry 16 is injected into the metal mold 12 from the opening for injecting a material into the space of the metal mold 12 as indicated by an arrow 14. Specifically, a core 18 is manufactured by so-called injection molding while injecting the ceramic slurry 16 into the metal mold 12. In the mold manufacturing method, when the core 18 is manufactured inside the metal mold 12, the core 18 is separated from the metal mold 12 and the separated core 18 is baked while being disposed in a combustion furnace 20. Thus, the core 18 formed of ceramic is baked and hardened (step S102). Here, as the material of the ceramic slurry 16, "two kinds of silica materials having different particle diameters" were used.

Subsequently, in order to form a coating layer on the surface of the core 18, the sintered core 18 is immersed into a storage portion 17 filled with slurry 19 and is extracted so as to be dried (step S103). Subsequently, the immersed core 18 is extracted and is baked while being disposed in the combustion furnace 20. Thus, the coating layer 19*a* is formed on the surface of the core 18 formed of ceramic (step S104).

In the mold casting method, the core 18 provided with the coating layer 19*a* is manufactured as described above. Furthermore, the core 18 is formed of a material which can be removed after the cast metal is hardened by a core removal process such as a chemical treatment.

Figure 5:
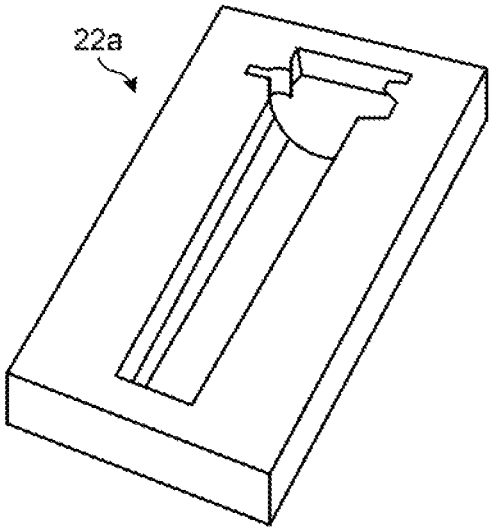
FIG. 5 is a schematic perspective view illustrating a part of a metal mold.

In the mold manufacturing method, an outer metal mold is manufactured after the core 18 is manufactured (step S14). The outer metal mold is formed in a shape in which the inner peripheral surface corresponds to the outer peripheral surface of the cast metal. The metal mold may be formed of metal or ceramic. FIG. 5 is a schematic perspective view illustrating a part of the metal mold. In a metal mold 22*a* illustrated in FIG. 5, a recess formed in the inner peripheral surface corresponds to the outer peripheral surface of the cast metal. Furthermore, only the metal mold 22*a* is illustrated in FIG. 5, but another metal mold corresponding to the metal mold 22*a* is also manufactured in a direction in which the recess formed on the inner peripheral surface is covered so as to correspond to the metal mold 22*a*. In the mold manufacturing method, when two metal molds are combined with each other, a mold is obtained the inner peripheral surface of which corresponds to the outer peripheral surface of the cast metal.

Figure 6:
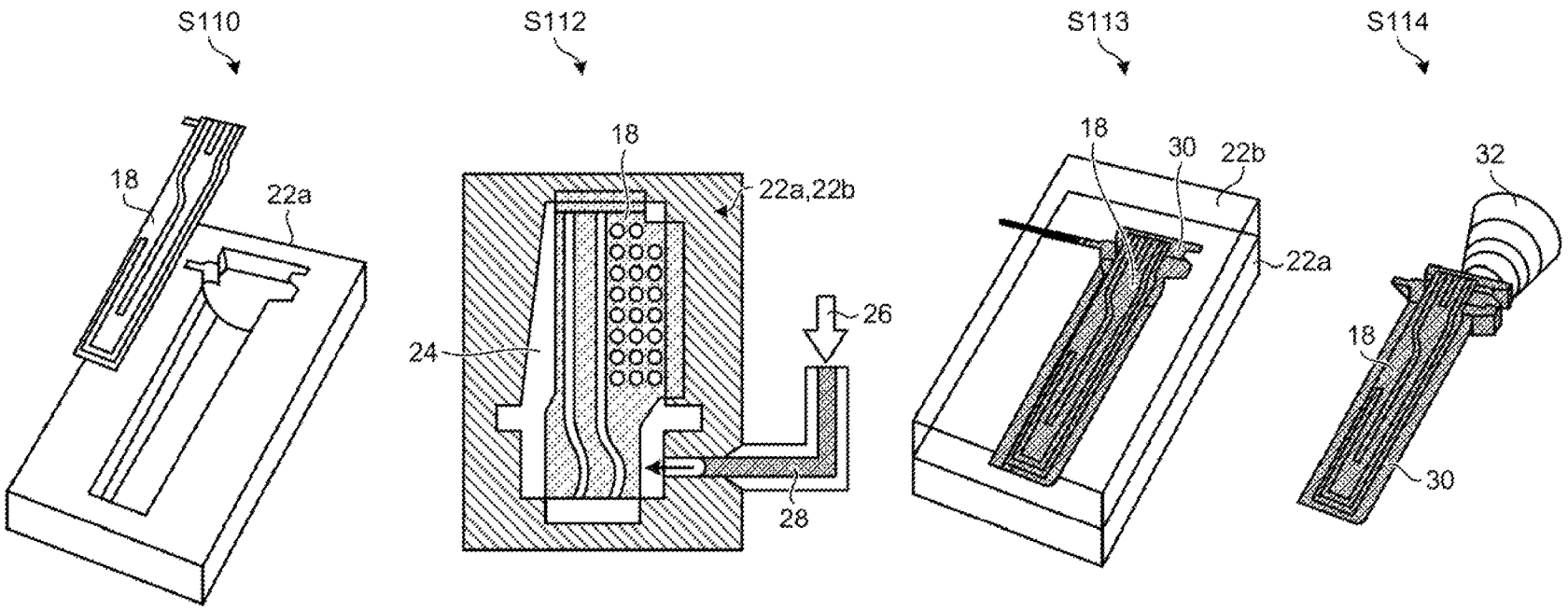
FIG. 6 is a schematic diagram illustrating a wax pattern manufacturing process.

In the mold manufacturing method, a wax pattern (a wax mold) is manufactured after the outer metal mold is manufactured (step S16). Hereinafter, this process will be described with reference to FIG. 6. FIG. 6 is a schematic diagram illustrating a wax pattern manufacturing process. In the mold manufacturing method, the core 18 is disposed at a predetermined position of the metal mold 22*a* (step S110). Subsequently, a metal mold 22*b* corresponding to the metal mold 22*a* covers the surface provided with the recess of the metal mold 22*a* while surrounding the periphery of the core 18 by the metal molds 22*a* and 22*b* so that a space 24 is formed by the core 18 and one metal molds 22*a* and 22*b*. In the mold manufacturing method, wax 28 starts to be injected into the space 24 from a pipe connected to the space 24 as indicated by an arrow 26 (step S112). Here, the wax 28 is a material, for example, a wax, the melting point of which is comparatively low and which is heated and melted at a predetermined temperature or more. In the mold manufacturing method, the wax 28 is charged into the entire area of the space 24 (step S113). Subsequently, a wax pattern 30 in which the wax 28 surrounds the periphery of the core 18 is formed by hardening the wax 28. The wax pattern 30 is formed so that a portion basically formed of the wax 28 is formed in the same shape as the cast metal to be manufactured. Subsequently, in the cast metal manufacturing method, the wax pattern 30 is separated from the metal molds 22*a* and 22*b* and a sprue 32 is attached thereto (step S114). The sprue 32 is an opening into which molten metal as melted metal is input during casting. In the mold manufacturing method, the wax pattern 30 which has the core 18 therein and is formed of the wax 28 having the same shape as the cast metal is manufactured as described above.

Figure 7:
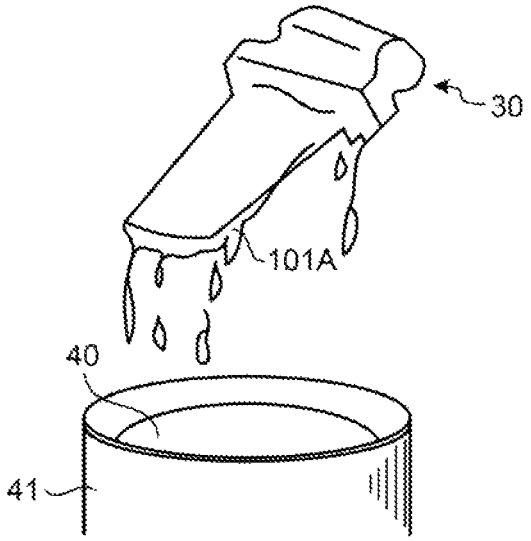
FIG. 7 is a schematic diagram illustrating a configuration of applying slurry to a wax pattern.
Figure 8:
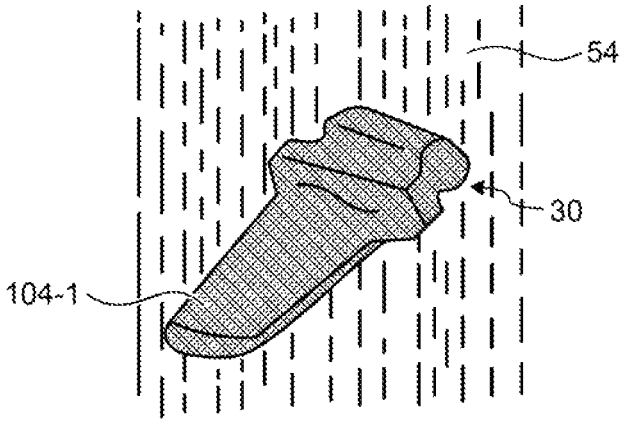
FIG. 8 is a schematic diagram illustrating an outer mold manufacturing process.

In the mold manufacturing method, slurry applying (dipping) is performed after the wax pattern 30 is manufactured (step S18). FIG. 7 is a schematic diagram illustrating a configuration of applying slurry to a wax pattern. FIG. 8 is a schematic diagram illustrating an outer mold manufacturing process. In the mold manufacturing method, as illustrated in FIG. 7, the wax pattern 30 is immersed into a storage portion 41 filled with slurry 40 and is extracted so as to be dried (step S19). Thus, a prime layer 101A can be formed on the surface of the wax pattern 30.

Here, the slurry which is applied in step S18 is slurry directly applied to the wax pattern 30. As the slurry 40, slurry obtained by solely dispersing alumina ultrafine particles therein is used. In the slurry 40, it is desirable to use fireproof micro particles, for example, zirconia of about 350 mesh as flour. Further, it is desirable to use polycarboxylic acid as a dispersing agent. Further, it is desirable to add a small amount of a defoaming agent (a silicon material) or a wettability improving agent by, for example, 0.01% to the slurry 40. When the wettability improving agent is added to the slurry, it is possible to improve the adhesion property of the slurry 40 to the wax pattern 30.

In the mold manufacturing method, as illustrated in FIG. 7, slurry applying (dipping) is performed on the wax pattern having the prime layer (the first dry film) 101A by applying and drying the slurry 40 (step S20). Subsequently, as illustrated in FIG. 8, stuccoing is performed in which zircon stucco grains (having an average particle diameter of 0.8 mm) as a stucco material 54 are sprinkled to the stir face of the wet slurry (step S21). Subsequently, a layer of the wet slurry in which the stucco material 54 attached to the surface of thereof is dried so as to form a first back-up layer (a second dry film) 104-1 on the prime layer (the first dry film) 101A (step S22).

It is determined whether to repeat the process of forming the first back-up layer (the second dry film) 104-1 a plurality of times (for example, n: 6 to 10 times) (step S23). The n-th back-up layer 104-*n* is laminated a predetermined number of times (n) (step S23: Yes), so that a dried compact 106A is formed as an outer mold with one thickness of a multi-layered back-up layer 105A of, for example, 10 mm.

Figure 9:
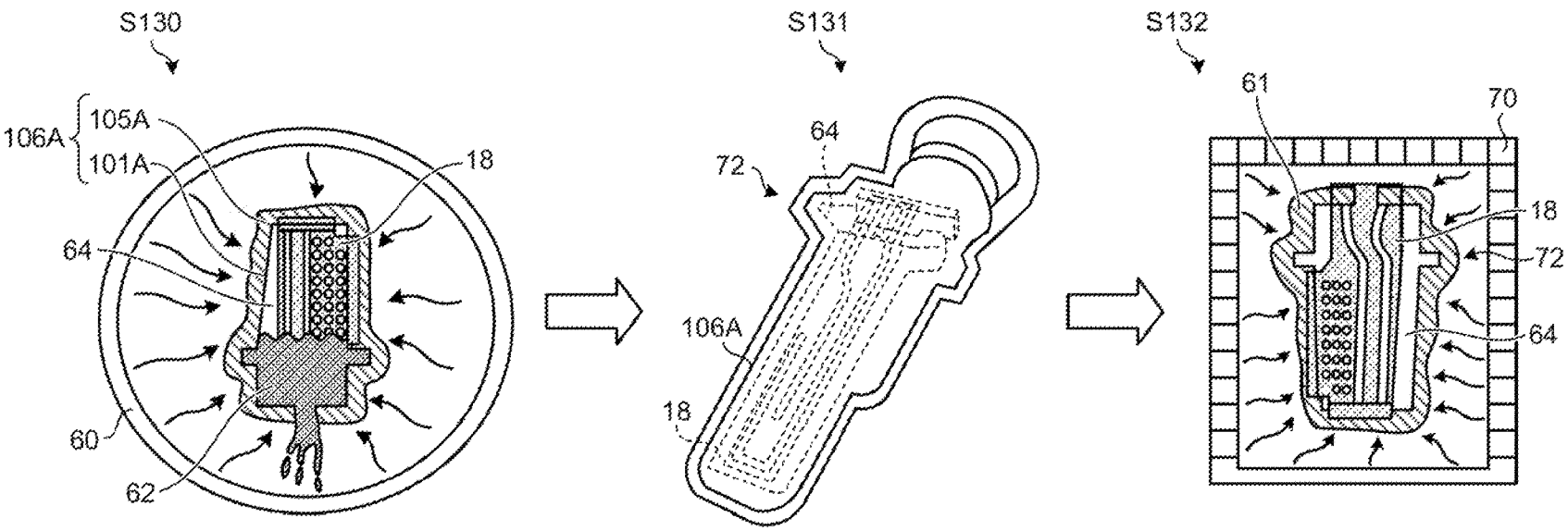
FIG. 9 is a schematic diagram illustrating a part of a process of the mold manufacturing method.

In the mold manufacturing method, when a dried compact 106A provided with a plurality of layers of the prime layer 101A and the multi-layered back-up layer 105A is obtained, a heat treatment is performed on the dried compact 106A (step S24). Specifically, the wax between the outer mold and the core is removed, and the outer mold and the core are sintered. Hereinafter, this will be described with reference to FIG. 9. FIG. 9 is a schematic diagram illustrating a part of the process of the mold manufacturing method. In the mold manufacturing method, as illustrated in step S130, the dried compact 106A as the outer mold provided with a plurality of layers of the prime layer 101A and the multi-layered back-up layer 105A is heated while being disposed inside an autoclave 60. The autoclave 60 heats the wax pattern 30 inside the dried compact 106A by charging pressurized steam thereinto. Thus, the wax forming the wax pattern 30 is melted so that melted wax 62 is discharged from a space 64 surrounded by the dried compact 106A.

In the mold manufacturing method, since the melted wax 62 is discharged from the space 64, a mold 72 is manufactured in which the space 64 is formed in an area filled with the wax between the core 18 and the dried compact 106A as the outer mold as illustrated in step S131. Subsequently, in the mold manufacturing method, the mold 72 provided with the space 64 between the core 18 and the dried compact 106A as the outer mold is heated by a combustion furnace 70 as illustrated in step S132. Thus, an unnecessary component or a moisture component included in the dried compact 106A as the outer mold is removed from the mold 72, and the mold is sintered and hardened so that the outer mold 61 is formed. In the cast metal manufacturing method, the mold 72 is manufactured as described above.

Figure 10:
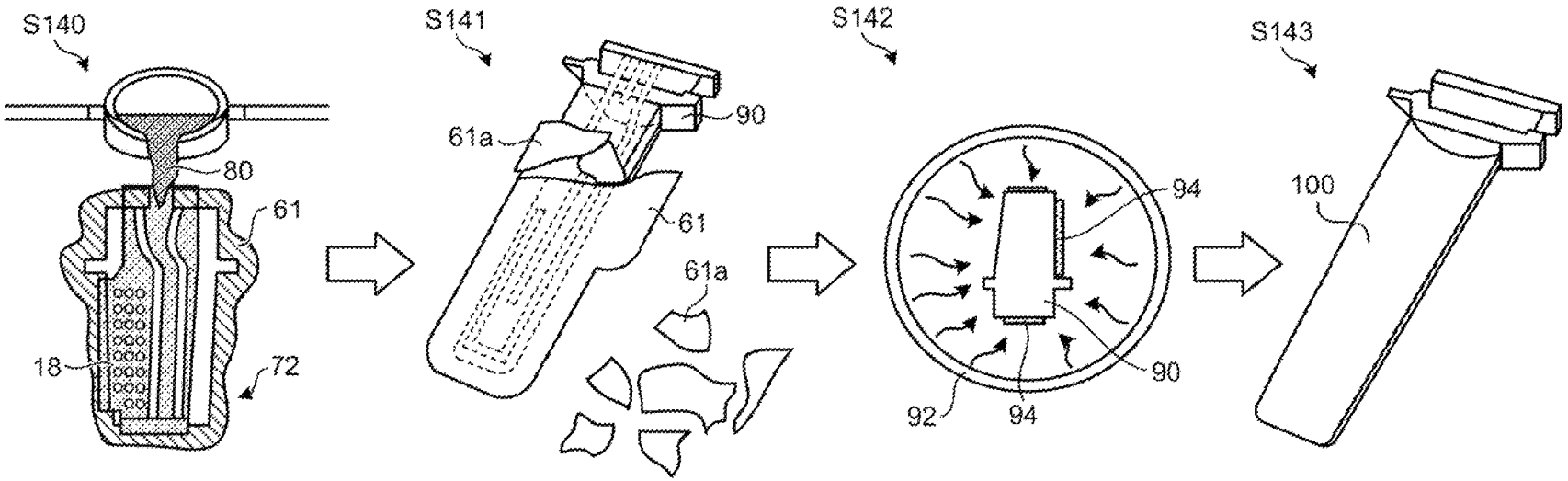
FIG. 10 is a schematic diagram, illustrating a part of a process of the casting method.

Referring to FIGS. 2 to 10, the casting method will be continuously described. FIG. 10 is a schematic diagram illustrating a part of a process of the casting method. In the casting method, the mold is preheated after the mold is manufactured in step S1 (step S2). For example, the mold is disposed in a furnace (a vacuum furnace and a combustion furnace) and is heated in the range of 800° C.-900° C. Due to the preheat treatment, it is possible to suppress the breakage of the mold when molten metal (melted metal) is injected into the mold to manufacture the cast metal.

In the casting method, pouring is performed after the mold is preheated (step S3). That is, as illustrated in step S140 of FIG. 10, molten metal 80, that is, a raw material (for example, steel) of melted cast metal is injected from the opening of the mold 72 into a gap between the outer mold 61 and the core 18.

In the casting method, the outer mold 61 is removed after the molten metal 80 poured into the mold 72 is solidified (step S4). That is, when the cast metal 90 is obtained by solidifying the molten metal inside the mold 72 as illustrated step S141 of FIG. 10, the outer mold 61 is milled so as to be separated as a fragment 61*a* from the cast metal 90.

In the casting method, the core removal process is performed after the outer mold 61 is removed from the cast metal 90 (step S5). That is, as illustrated in step S142 of FIG. 10, a core removal process is performed by inserting the cast metal 90 into an autoclave 92. Then, the core 18 inside the cast metal 90 is melted, and a melted core 94 is discharged from the inside of the cast metal 90. Specifically, the cast metal 90 is dipped in an alkali solution inside the autoclave 92 and is pressurized and de-pressurized repeatedly so as to discharge the melted core 94 from the cast metal 90.

In the casting method, a finishing treatment is performed after the core removal process is performed (step S6). That is, a finishing treatment is performed on the surface or the inside of the cast metal 90. Further, in the casting method, the quality of the cast metal is checked along with the finishing treatment. Thus, a cast metal 100 can be manufactured as illustrated in step S143 of FIG. 10.

In the casting method of the embodiment, the cast metal is manufactured by manufacturing the mold by the use of the lost-wax casting method using wax as described above.

Here, in the mold manufacturing method, the casting method, and the mold of the embodiment, the outer mold as the outer portion of the mold is formed as a multi-layer structure in which the prime layer (the first dry film as the prime layer) 101A is formed as the inner peripheral surface by using alumina ultrafine particles as slurry and the multi-layered back-up layer 105A is formed on the outside of the prime layer 101A.

Since the coating layer is formed on the surface of the core in the casting method of the embodiment, the dimensional precision is improved, and hence the durability is improved even at a high casting temperature.

Further, since the high-strength core is provided, the degree of freedom in design (for example, a slow pulling-down speed or the like) of the casting is improved even at the long casting process time.

Furthermore, it is possible to provide a precision-cast product such as a turbine blade which is thin and has good thermal efficiency.

As the precision-cast product according to the invention, for example, a gas turbine stator vane, a gas turbine combustor, a gas turbine split ring, or the like can be exemplified other than the gas turbine blade.

Second Embodiment

Since the embodiment has the same configuration as the precision-casting core of the first embodiment, a description will be made with reference to the drawings (FIGS. 1 and 2) of the first embodiment.

FIG. 1 is a cross-sectional configuration diagram of a precision-casting core.

A precision-casting core according to the invention is obtained by forming a coating layer including a silica material and an alumina material on a surface of a sintered precision-casting core body (hereinafter, referred to as a "core body") mainly including silica particles.

As illustrated in the upper stage of the cross-sectional view of the core body as the sintered body of FIG. 1, a plurality of holes 18*c* is formed, in a surface 18*b* of a core body 18*a* during sintering.

In the invention, as illustrated in the lower stage of FIG. 1, the holes 18*c* are sealed by coating the holes 18*c* formed in the surface by a coating layer 19*a*.

Here, the core body 18*a* mainly includes silica particles, for example, melted silica ($SiO_2$) such as silica sand and silica flour.

The core body 18*a* is manufactured by a known method, in which wax is added to a mixture prepared by mixing silica particles, for example, silica flour (for example, 800 mesh (10 to 20 μm)) and silica sand (for example, 220 mesh (20 to 70 μm)) at the weight ratio of 1:1 and is heated and kneaded so as to obtain a compound.

A core compact is obtained by injection molding the obtained compound.

Subsequently, the core body 18*a* is obtained by performing a decreasing treatment to, for example, 600° C. and a sintering treatment at, for example, 1,200° C.

In the invention, the coating layer 19*a* is formed on the surface of the core body 18*a* as the obtained sintered body.

The silica material and the alumina material are used in the coating layer 19*a*.

Here, the silica material is silica sol ($SiO_2$ of 30 wt %) and the alumina material is alumina sol ($Al_2O_3$).

Silica sol ($SiO_2$) and alumina sol ($Al_2O_3$) are mixed at the molar ratio of 2:3 so as to prepare mixed sol (silica-alumina sol).

A core sample is immersed into the prepared silica-alumina sol and is pulled up so as to form a layer of silica-alumina sol on the surface 18*b* of the core body 18*a* and to precipitate silica-alumina sol even in the hole 18*c* of the core surface.

Subsequently after the drying process, for example, a heat treatment is performed at 1,000° C. The heat treatment may be performed at, for example, 1,000° C. or less if the surface is provided with the coating layer 19*a*.

In the heat treatment, silica-alumina sol changes to mullite ($3Al_2O_3.2SiO_2$) having a high melting point due to a reaction. Thus, it is possible to obtain the core 18 in which the core body 18*a* is covered by the mullite coating layer 19*a*.

Here, since the melting point of mullite is 1,500° C. and is higher than the melting point (1,600° C. of silica, the high casting temperature can be handled.

In this way, according to the invention, since the plurality of holes formed in the surface is sealed, it is possible to prevent a problem in which the core is broken during casting from the holes as the start points in the related art. Accordingly, the high-temperature strength of the precision-casting core is improved.

Test Example 2

Hereinafter, a test example for verifying the effect of the invention will be described.

In the test example, a compound was first obtained by adding wax to a mixture prepared by mixing silica flour (800 mesh) and silica sand (220 mesh) at the weight ratio of 1:1 and heating and kneading the mixture. Here, "MCF-200C" (product name) manufactured by Tatsumori Ltd. was used as silica flour, "RD-120" (product name) manufactured by Tatsumori Ltd, was used as silica sand, and "Cerita Wax F30-75" (product name) manufactured by Paramelt Co., Ltd., was used as wax.

A compact was obtained by injection molding the obtained compound.

As a test sample, a sample having a width of 30 mm, a length of 200 mm, and a thickness of 5 mm was obtained.

Next, Sample 2 for a core body was obtained by performing a decreasing treatment to 600° C. and a sintering treatment at 1,200° C.

Next, silica sol ($SiO_2$) and alumina sol ($Al_2O_3$) were mixed at the mixing ratio (the molar ratio=2:3) causing mullite so as to prepare mixed sol (silica-alumina sol).

The sample for the core body was immersed into the obtained silica-alumina sol and was pulled up so as to form the coating layer 19*a* of silica-alumina sol on the surface thereof. Subsequently after the drying process, a heat treatment was performed at 1,000° C. so as to form the coating layer 19*a* on the core body surface 18*b* by the mullite obtained by the reaction of silica-alumina sol.

As a comparative example, a core body without a coating layer was prepared as Comparative Sample 2.

The strength of each of the test samples was measured.

Here, the strength test was performed based on "Bending Strength of Ceramics (1981)" of JIS R 1601.

The strength of the comparative sample without the coating layer of the conventional method was 20 MPa, but, to the contrary, the strength of the sample for the core body according to the method of the invention was 26 MPa. As a result, in the sample for the core body of the invention, it was acknowledged that the strength was improved by 30%.

According to the invention, since the high-temperature durability of the core is improved due to the mullite, it is possible to obtain a mold which is not deformed even when the mold is held at a high temperature (for example, 1,550° C.) for a long period of time, for example, when a unidirectional solidified turbine blade is manufactured.

Here, in the casting method using the mold provided with the precision-casting core of the embodiment, the configuration is the same except that "two kinds of silica materials having different particle diameters" as the material of the ceramic slurry 16 used in the method of the first embodiment are changed to the "material including the silica material and the alumina material", and hence the description thereof will not be presented.

Third Embodiment

Since the embodiment has the same configuration as the precision-casting core of the first embodiment, a description, will be made with reference to the drawings (FIGS. 1 and 2) of the first embodiment.

FIG. 1 is a cross-sectional configuration diagram of a precision-casting core.

A precision-casting core according to the invention is obtained by forming a coating layer including a silica material, an alumina material, and silica fume on a surface of a sintered precision-casting core body (hereinafter, referred to as a "core body") mainly including silica particles.

As illustrated in the upper stage of the cross-sectional view of the core body as the sintered body of FIG. 1, a plurality of holes 18*c* is formed, in a surface 18*b* of a core body 18*a* during sintering.

In the invention, as illustrated in the lower stage of FIG. 1, the holes 18*c* are sealed by coating the holes 18*c* formed in the surface by the coating layer 19*a*.

Here, the core body 18*a* mainly includes silica particles, for example, melted silica ($SiO_2$) such as silica sand and silica flour.

The core body 18*a* is manufactured by a known method in which wax is added to a mixture prepared by mixing silica particles, for example, silica flour (for example, 800 mesh (10 to 20 μm)) and silica sand (for example, 220 mesh (20 to 70 μm)) at the weight ratio of 1:1 and is heated and kneaded so as to obtain a compound.

A core compact is obtained, by injection molding the obtained compound.

Subsequently, the core body 18*a* is obtained by performing a degreasing treatment to, for example, 600° C. and a sintering treatment at, for example, 1,200° C.

In the invention, the coating layer 19*a* is formed on the surface of the core body 18*a* as the obtained sintered body, A silica material, an alumina material, and silica fume are used in the coating layer 19*a*.

Here, the silica material is silica sol ($SiO_2$ of 30 wt %) and the alumina material is alumina sol ($Al_2O_3$).

Here, the dispersion ratio of silica fume dispersed in the silica material and the alumina material is set to 5 to 40 wt % and appropriately about 20 wt %.

It is desirable that silica fume have a particle diameter of 0.05 to 0.5 μm.

Here, silica sol ($SiO_2$) and alumina sol ($Al_2O_3$) are mixed at the molar ratio of 2:3 so as to prepare mixed sol (silica-alumina sol) (in which the particle diameters of dispersed particles are from 1 to several hundreds of nanometers).

Silica fume is added and dispersed in the prepared silica-alumina sol so as to prepare silica-alumina sol-silica fume slurry.

A core sample is immersed into the prepared silica-alumina sol-silica fume slurry and is pulled up so as to form a layer of silica-alumina sol-silica fume on the surface 18*b* of the core body 18*a* and to precipitate a silica-alumina sol-silica fume component even in the hole 18*c* of the core surface.

Subsequently after the drying process, for example, a heat treatment is performed at 1,000° C. The heat treatment may be performed at, for example, 1,000° C. or less if the surface is provided with the coating layer 19*a*.

In the heat treatment, silica-alumina sol changes to mullite ($3Al_2O_3.2SiO_2$) having a high melting point due to a reaction. Since the gap of silica fume layer having a large particle size is filled by compact mullite layer, it is possible to obtain the core 18 the core body 18*a* of which is covered by the coating layer 19*a* having the improved adhesion strength among particles.

Here, since the melting point of mullite is 1,900° C. and is higher than the melting point (1,600° C.) of silica, the high casting temperature can be handled.

In this way, according to the invention, since the plurality of holes formed in the surface is sealed, it is possible to prevent a problem in which the core is broken during casting from the holes as the start points in the related art. Accordingly, the high-temperature strength of the precision-casting core is improved.

Further, since silica fume has a large particle size, heat shrinking is small even at the heat treatment of 1,000° C.

Test Example 3

Hereinafter, a test example for verifying the effect of the invention will be described.

In the test example, a compound was first obtained by adding wax so a mixture prepared by mixing silica flour (800 mesh) and silica sand (220 mesh) at the weight ratio of 1:1 and heating and kneading the mixture. Here, "MCF-200C" (product name) manufactured by Tatsumori Ltd. was used as silica flour, "RD-120" (product name) manufactured by Tatsumori Ltd. was used as silica sand, and "Cerita Wax F30-75" (product name) manufactured by Paramelt Co., Ltd., was used as wax.

A compact was obtained by injection molding the obtained compound.

As a test sample, a sample having a width of 30 mm, a length of 200 mm, and a thickness of 5 mm was obtained.

Next, Sample 3 for a core body was obtained by performing a degreasing treatment to 600° C. and a sintering treatment at 1,200° C.

Next, silica sol ($SiO_2$) and alumina sol ($Al_2O_3$) were mixed at the mixing ratio (the molar ratio of 2:3) causing mullite so as to prepare mixed sol (silica-alumina sol).

Silica fume (for example, a particle diameter 0.15 μm; a spherical material) of 20 wt % was mixed with the obtained silica-alumina sol so as to prepare silica-alumina sol-silica fume slurry mixed with silica fume.

The sample for the core body was immersed into the prepared silica-alumina sol-silica fume slurry and was pulled up so as to form the coating layer 19*a* of silica-alumina sol on the surface thereof. Subsequently after the drying process, a heat treatment was performed at 1,000° C. so as to form the coating layer 19*a* on the core body surface 18*b* by the mullite obtained by the reaction of silica-alumina sol including silica fume.

As a comparative example, a core body without a coating layer was prepared as Comparative Sample 3.

The strength of each of the test samples was measured.

Here, the strength test was performed based on "Bending Strength of Ceramics (1981)" of CIS R 1601.

The strength of the comparative sample without the coating layer of the conventional method was 20 MPa, but, to the contrary, the strength of the sample for the core body according to the method of the invention was 27 MPa. As a result, in the sample for the core body of the invention, it was acknowledged that the strength was improved by 35%.

According to the invention, since the high-temperature durability of the core is improved due to the mullite, it is possible to obtain a mold which is not deformed even when the mold is held at a high temperature (for example, 1,550° C.) for a long period of time, for example, when a unidirectional solidified turbine blade is manufactured.

Here, in the casting method using the mold provided with the precision-casting core of the embodiment, the configuration is the same except that "two kinds of silica materials having different particle diameters" as the material of the ceramic slurry 16 used in the method of the first embodiment are changed to the "material including the silica material, the alumina material, and the silica fume and hence the description thereof will not be presented.

REFERENCE SIGNS LIST

12, 22*a*, 22*b* METAL MOLD
12*a* CONVEX PORTION
14, 26 ARROW
16 CERAMIC SLURRY
18 CORE
18*a* CORE BODY
18*b* SURFACE
18*c* HOLE
19 SLURRY
19*a* COATING LAYER
20, 70 COMBUSTION FURNACE
24, 64 SPACE
28 WAX
30 WAX PATTERN
32 SPRUE
40 SLURRY
60, 92 AUTOCLAVE
61 OUTER MOLD
61*a* FRAGMENT
62 MELTED WAX
72 MOLD
80 MOLTEN METAL
90, 100 CAST METAL
94 MELTED CORE
101A PRIME LAYER

The invention claimed is:

1. A precision-casting core obtained by forming a coating layer of two kinds of silica materials having different particle diameters on a surface of a sintered precision-casting core body mainly including silica particles, wherein the two kinds of silica materials having different particle diameters comprise silica sol and silica fume having larger particle diameters than the silica sol, the silica fume consisting of spherical particles, and the silica sol and the silica fume have a weight ratio of 1:1 to 2:1.

2. A precision-casting mold used to manufacture cast metal, comprising:

a precision-casting core obtained by forming a coating layer of two kinds of silica materials having different particle diameters on a surface of a sintered precision-casting core body mainly including silica particles having a shape corresponding to a cavity inside the cast metal; and an outer mold corresponding to the shape of the outer peripheral surface of the cast metal, wherein the two kinds of silica materials having different particle diameters comprise silica sol and silica fume having larger particle diameters than the silica sol, the silica fume consisting of spherical particles, and the silica sol and the silica fume have a weight ratio of 1:1 to 2:1.

3. A precision-casting core manufacturing method comprising:

immersing a sintered body of a precision-casting core body mainly including silica particles into a coating material including two kinds of silica materials having different particle diameters;

drying the sintered body; and heating the sintered body so as to form a coating layer on the surface of the precision-casting core body, wherein the two kinds of silica materials having different particle diameters comprise silica sol and silica fume having larger particle diameters than the silica sol, the silica fume consisting of spherical particles, and the silica sol and the silica fume have a weight ratio of 1:1 to 2:1.

* * * * *